US005539926A

United States Patent [19]

Mantos

[11] Patent Number: 5,539,926

[45] Date of Patent: Jul. 30, 1996

[54] SPORTS TROUSERS

[76] Inventor: Phillip J. Mantos, 26 Willis St., Apt. #18, Framingham, Mass. 01701

[21] Appl. No.: 496,924

[22] Filed: Jun. 30, 1995

[51] Int. Cl.[6] ..... A41D 13/00; A41D 1/08

[52] U.S. Cl. ..... 2/23; 2/228; 2/234

[58] Field of Search ..... 2/227, 234, 2, 2/23, 405, 408, 228, 238

[56] References Cited

U.S. PATENT DOCUMENTS

| | | | |
|---|---|---|---|
| 2,396,599 | 3/1946 | O'Brien | 2/408 |
| 4,035,844 | 7/1977 | Atack et al. | 2/22 X |
| 4,389,733 | 6/1983 | Boykins, Jr. | 2/234 X |
| 4,619,004 | 10/1986 | Won | 2/238 X |
| 4,843,654 | 7/1989 | March | 2/228 X |
| 5,103,501 | 4/1992 | Mersels | 2/405 X |
| 5,134,726 | 8/1992 | Ross | 2/227 X |

FOREIGN PATENT DOCUMENTS

| | | | |
|---|---|---|---|
| 20137 | of 1889 | United Kingdom | 2/228 |

*Primary Examiner*—Paul C. Lewis

*Attorney, Agent, or Firm*—John P. McGonagle

[57] ABSTRACT

Trousers specifically designed for the wearer engaged in strenuous, albeit casual and informal, athletic activity. The trousers have padding to protect the thighs, knees, buttocks, and genital areas. The abdominal and upper back portions of the trousers are made as one whole piece tightly secured in the front by a vertical fly containing a vertical row of buttons. Beneath the front row of buttons the trousers have a pouch fly with a two-way zipper along three sides permitting the wearer to open and close the pouch fly from either side, and to open the fly outward. The abdominal, upper back and fly segments of the trousers have soft-lined padding, thereby providing comfort and protection. The hip seam arches over the wearer's hip joints thereby causing the trousers to collapse and crease where it would naturally do so when sitting or bending, forming a V-like pattern. The pouch fly top cross seam also forms a natural horizontal crease thereby forming a triangle pattern in the trouser crotch area. There are two outer leg seams on both legs. A resilient, stretchable material is sewn in the middle of seams for expandability. A resilient, stretchable material is also sewn into the back knee section for greater range of motion and a comfortable bend.

14 Claims, 6 Drawing Sheets

SPORTS TROUSERS

BACKGROUND OF THE INVENTION

This invention relates to trousers, and in particular to trousers worn by a man during casual and informal athletic activities.

Younger men tend to wear regular jeans-type trousers when engaged in casual and informal athletic activities such as bike riding, skateboarding, pick-up softball games, pick-up basketball games, tag football games, and the like. Even though these types of athletic activities are casual and informal, they are often quite strenuous. Jeans provide some protection to the legs from abrasions and scratches because of the general ruggedness of the denim material from which most jeans are made, however, the overall protection to the wearer from the waist downward is limited. Although well-worn jeans are generally comfortable, this comfort level will be lessened by the strenuous nature of informal athletic activity engaged in by the jeans wearer.

SUMMARY OF THE INVENTION

In view of the foregoing disadvantages inherent in the known types of trousers now present in the prior art, the present invention provides trousers specifically designed for the wearer engaged in strenuous, albeit casual and informal, athletic activity. As such, the general purpose of the present invention, which will be described subsequently in greater detail, is to provide trousers which provide greater protection and comfort to the wearer during casual and informal athletic activities than ordinary jeans, while still providing the wearer with trousers which have an attractive appearance in a casual setting.

To attain this, the present invention provides padding to protect the thighs, knees, buttocks, and genital areas. The abdominal and upper back portions of the trousers are made as one whole piece tightly secured in the front by a vertical fly containing a vertical row of buttons thereby providing means for tightening the wearer's abdomen in an inward manner while bracing the wearer's tail bone and lower back. Beneath the front row of buttons the trousers have a pouch fly with a two-way zipper along three sides permitting the wearer to open and close the pouch fly from either side, and to open the fly outward. The abdominal, upper back and fly segments of the trousers have soft-lined padding, thereby providing comfort and protection. The vertical fly provides more room for the wearer to put on and take off the trousers. The trouser seam construction is designed not only for protection and fashion but also for comfort. The hip seam arches over the wearer's hip joints thereby causing the trousers to collapse and crease where it would naturally do so when sitting or bending, forming a V-like pattern. The pouch fly top cross seam also forms a natural horizontal crease thereby forming a triangle pattern in the trouser crotch area. The outer leg seams are designed to expand when bending legs allowing more mobility and range of motion for legs. There are two outer leg seams on both legs. A resilient, stretchable material is sewn in the middle of seams for expandability. A resilient, stretchable material is also sewn into the back knee section for greater range of motion and a comfortable bend. The waistband is made of a resilient, stretchable material allowing the waist and stomach area to expand. Soft cloth material is sewn onto the interior of the abdomen, upper back, buttocks, crotch, and anus areas for softness and comfort. Although the padded parts are designed to protect, they are also intended to enhance the features of the male body causing an illusion of a muscular tone structure for the buttocks, thighs, knees, and crotch area.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 2:
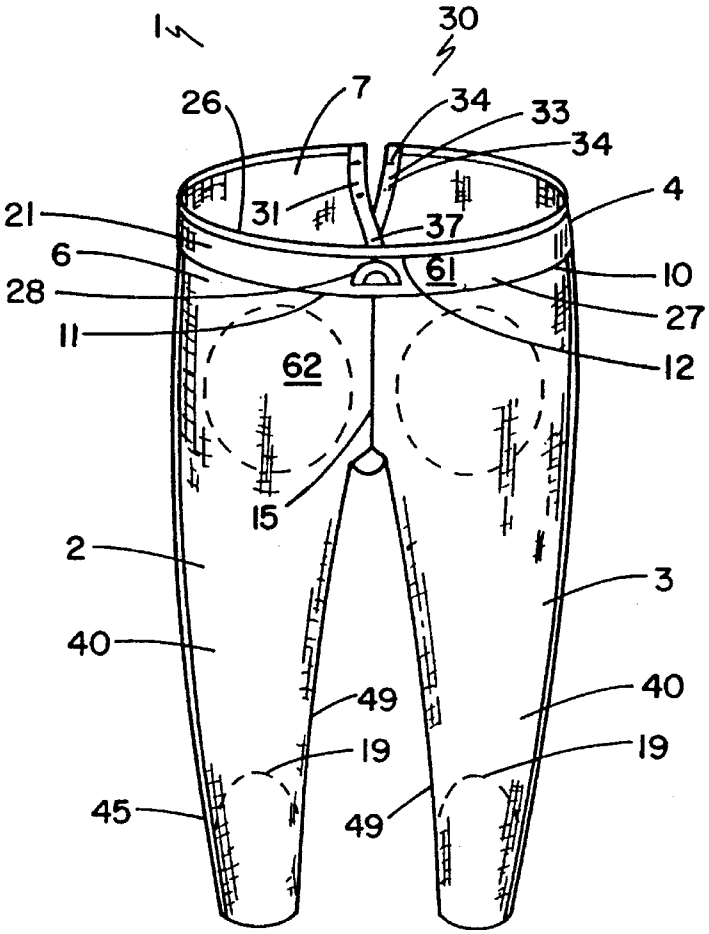
FIG. 2 is a rear plan view of the invention.
Figure 1:
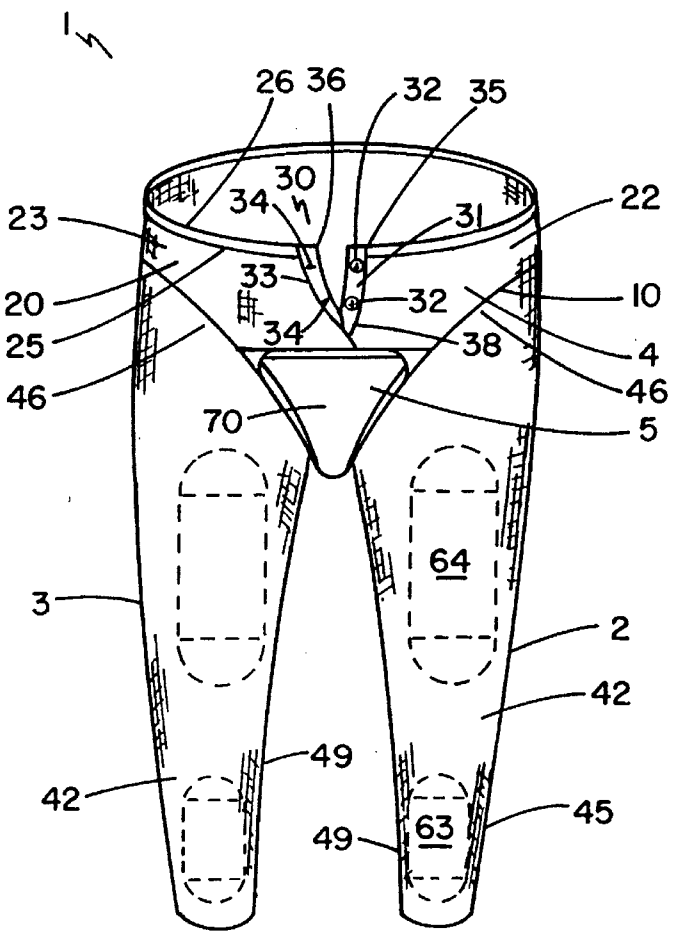
FIG. 1 is a front plan view of the invention.
Figure 3:
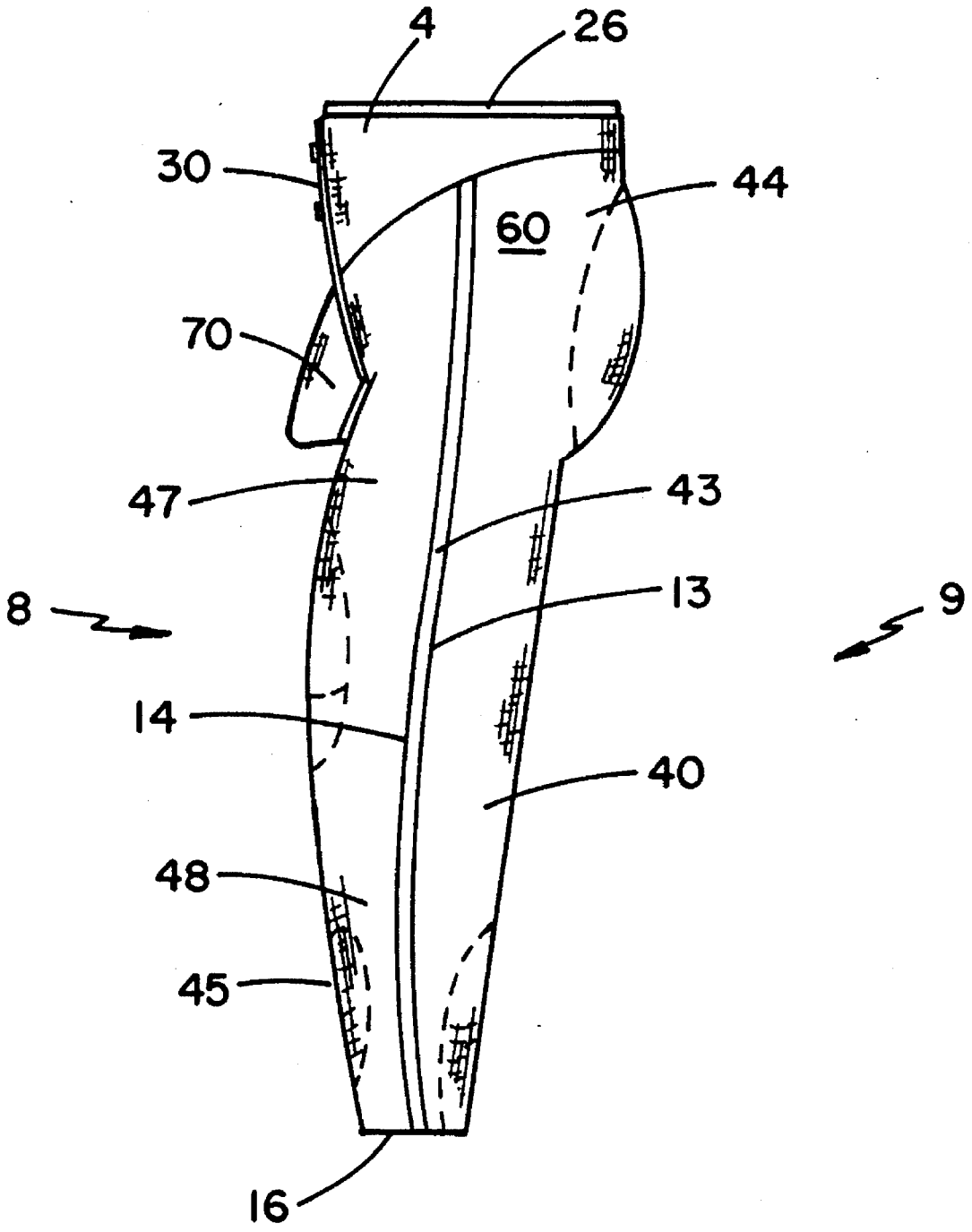
FIG. 3 is a left side plan view of the invention.

Referring to the drawings in detail wherein like elements are indicated by like numerals, there is shown an embodiment of sports trousers 1 constructed according to the present invention. The trousers 1 have two leg portions 2, 3, an abdominal/lower back section 4, a crotch section 5, and an exterior 6 and an interior 7. FIGS. 1 and 2 show front 8 and rear 9 exterior 6 views of the trousers 1. Referring also to FIG. 3, the abdominal/lower back section 4 is joined to the leg sections 2, 3 so that the resulting seam 10 arches over the hip joint areas 60 and continuously runs across the lower back area 61. That portion of the seam 10 running across the lower back area 61 is identified with the numeric 11.

Figure 4:
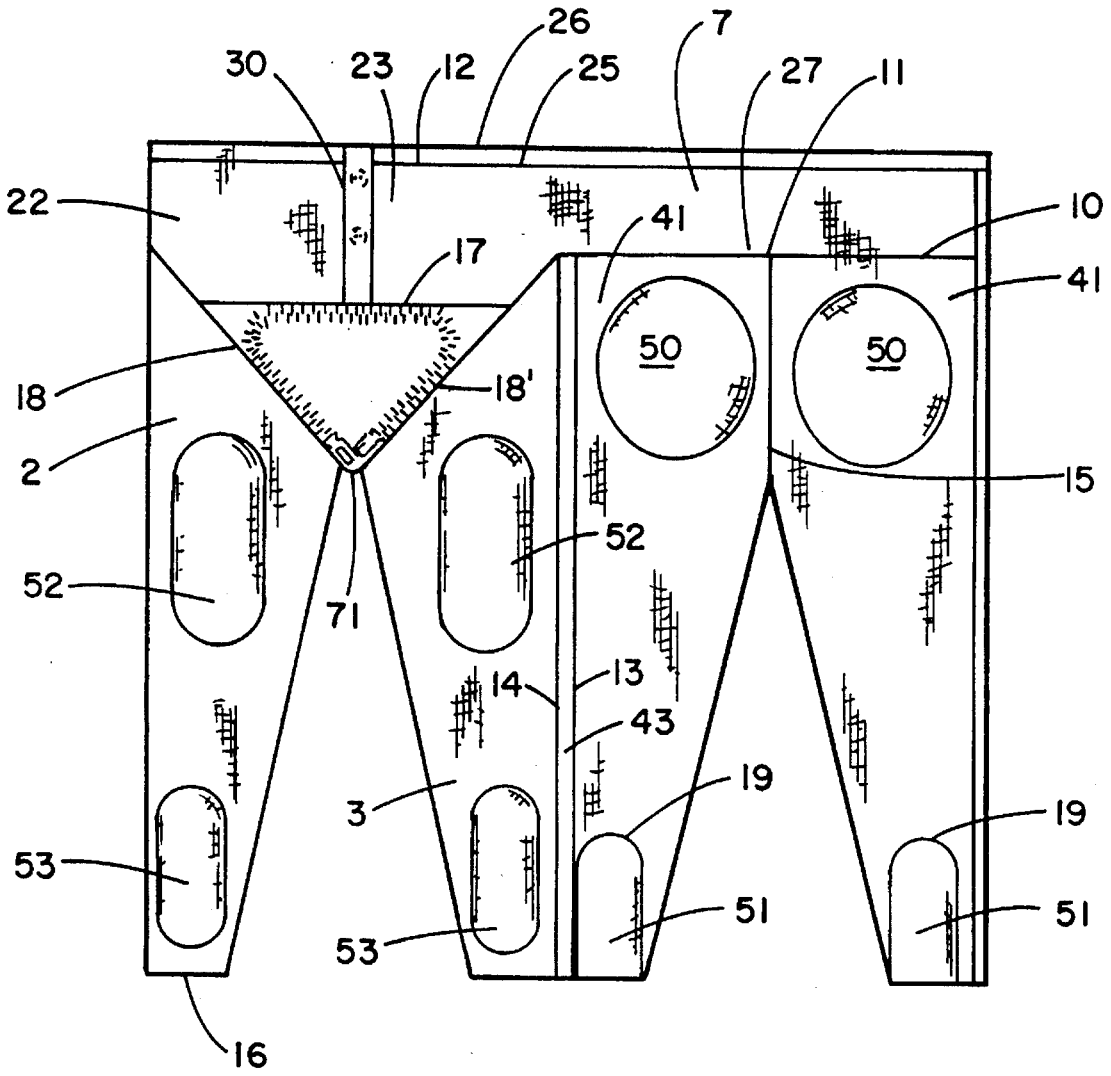
FIG. 4 is a full interior pattern view of the invention.
Figure 5:
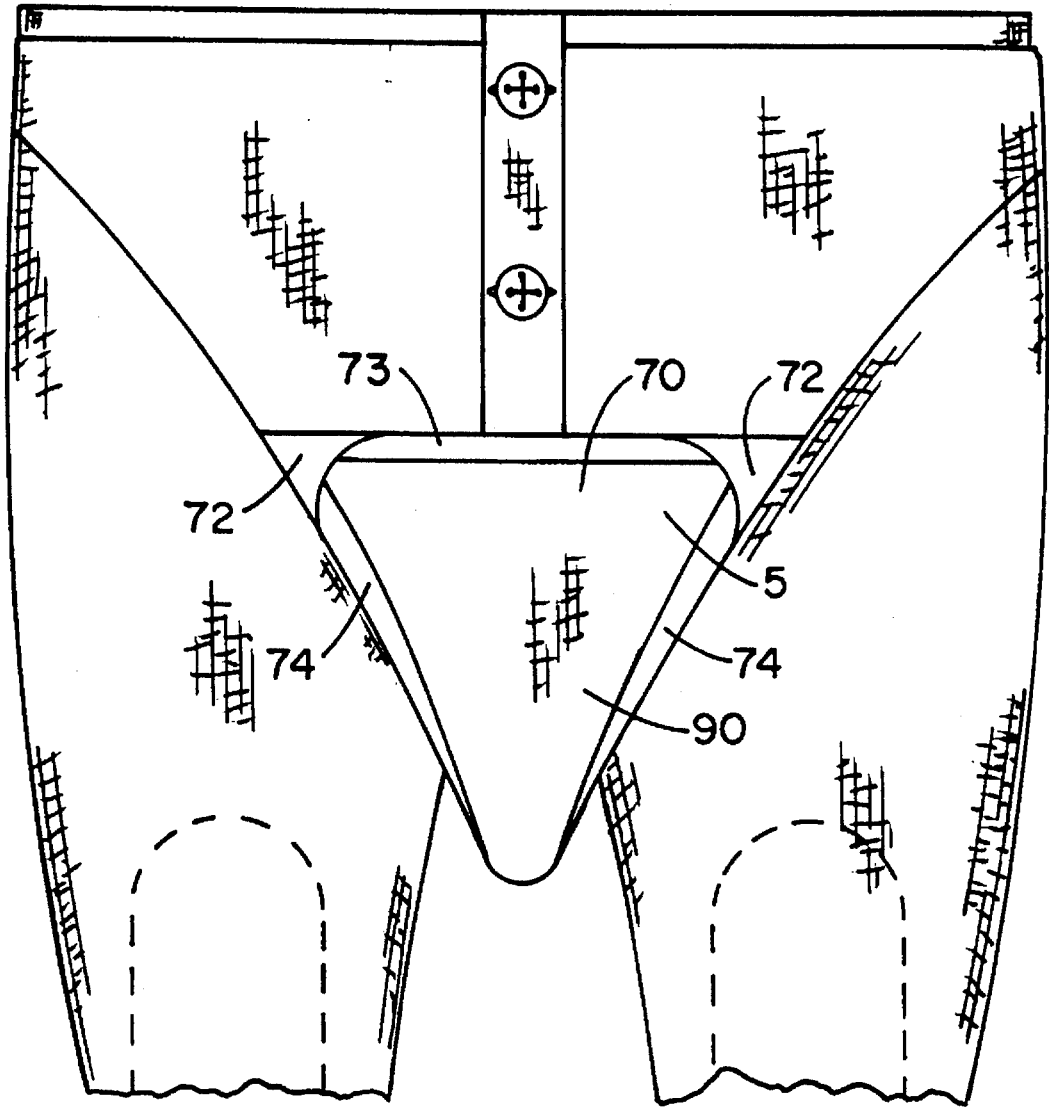
FIG. 5 is a close up exterior view of the front crotch area of the invention.
Figure 6:
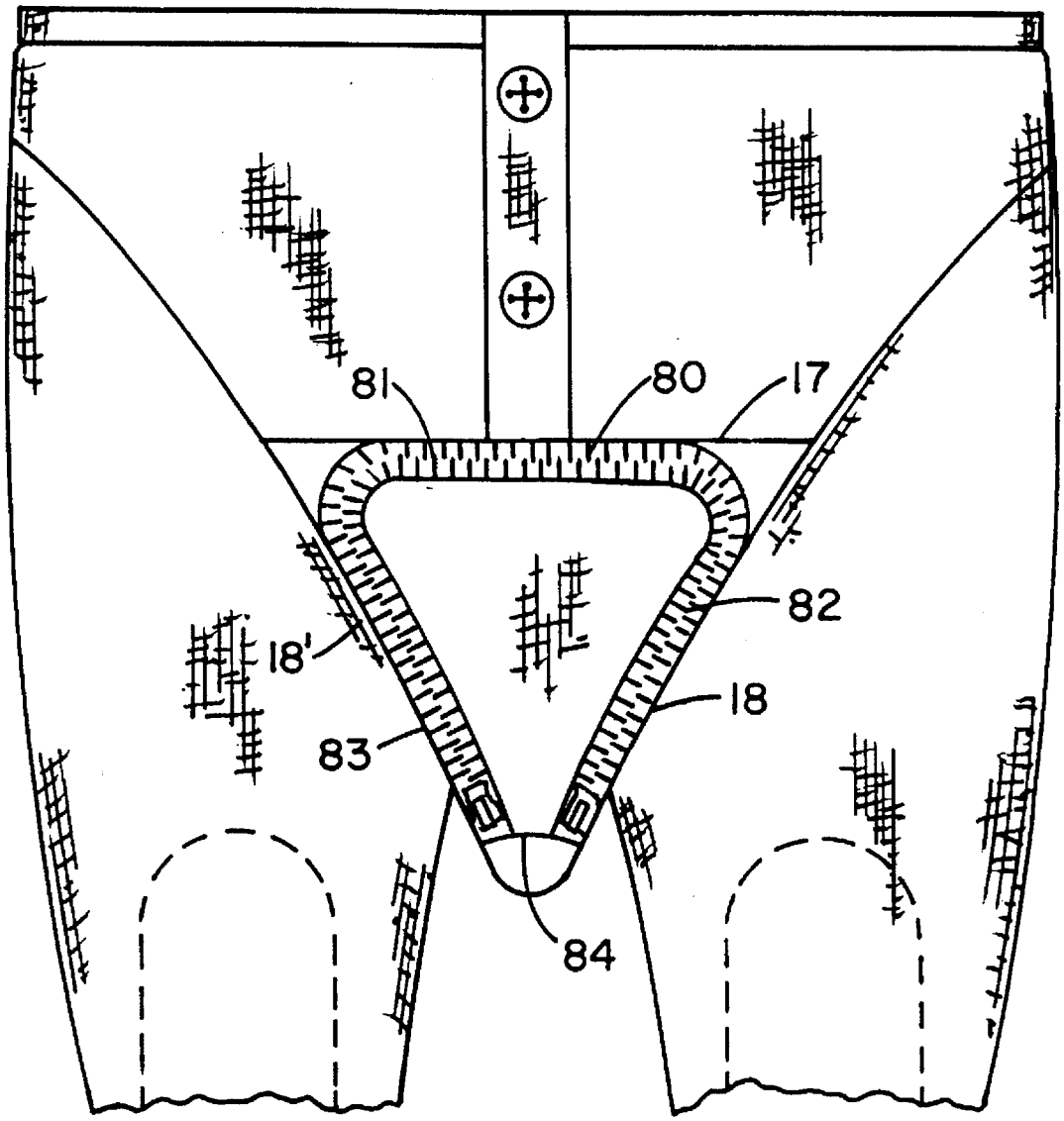
FIG. 6 is a close up exterior view of the front crotch area of the invention, partly in section, with pouch fly flap removed.
Figure 7:
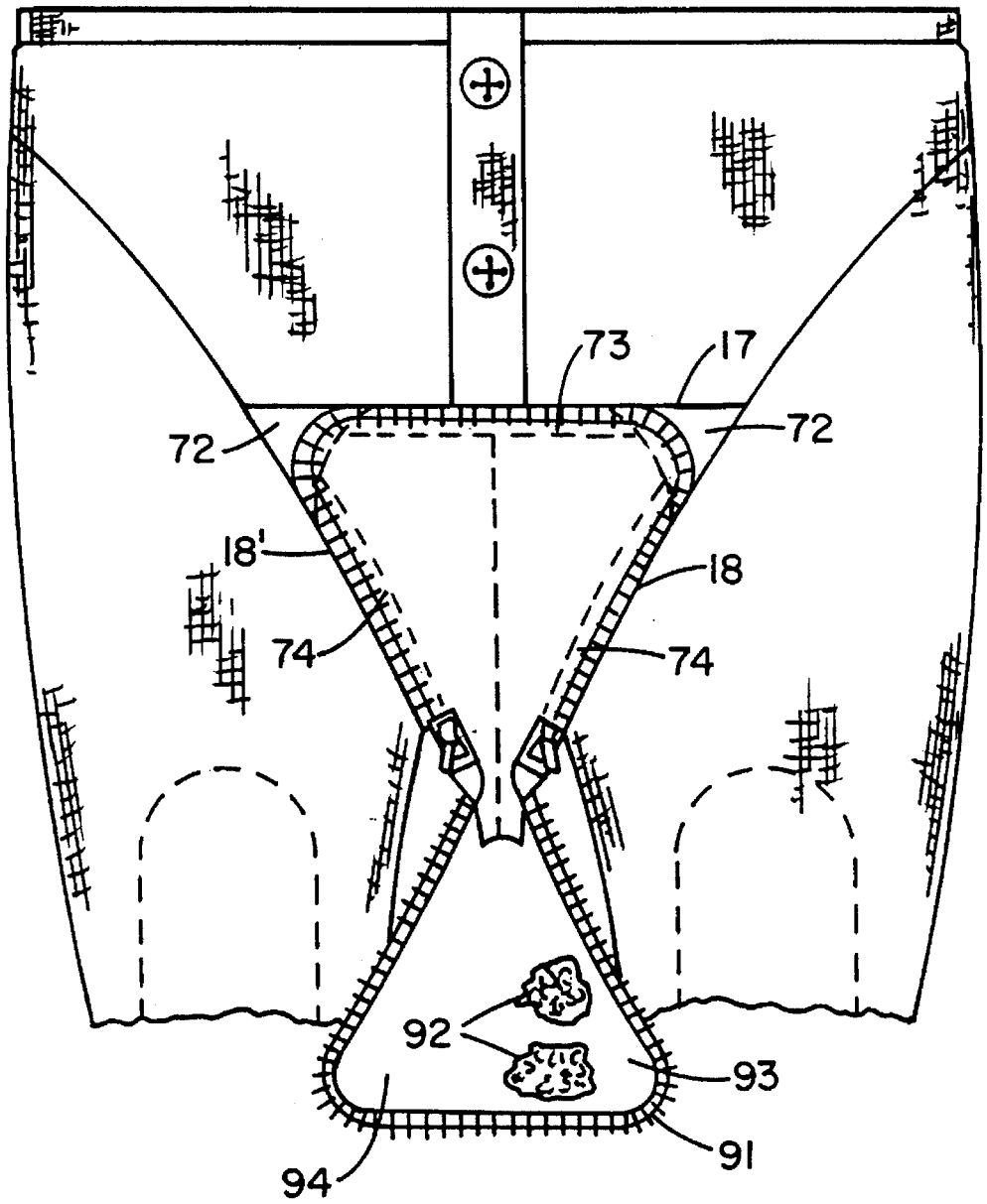
FIG. 7 is a close up exterior view of the front crotch area of the invention, partly in section and having the pouch fly flap in place, but fully open.

The abdominal/lower back section 4 is divided into a front abdomen portion 20 and a rear lower back portion 21. The abdominal/lower back section 4 containing the front abdomen portion 20 and rear lower back portion 21 forms a belt like structure fastened in the front abdomen portion 20 by a vertical button fly 30. As may be most clearly seen in FIG. 4, the button fly 30 vertically and centrally divides the abdomen portion 20 in half. In this embodiment of the invention, the left half 22 of the abdomen portion 20 terminates centrally in a vertical strip 31 with a vertical row of two or more buttons 32 sewn thereon. The right half 23 of the abdomen portion 20 terminates centrally in a vertical strip 33 with a vertical row of button holes 34 corresponding to the number of buttons 32 formed therein. The vertical strips 31 and 33 are joined at their bottoms 37, 38, respectively. The tops 35, 36 of the vertical strips 31, 33 are not joined. The vertical strips 31 and 33, along with their buttons 32 and button holes 34 form the vertical button fly 30. The top 24 of the abdomen/lower back section 4 terminates in a waist band 26. The waist band 26 begins horizontally at the top 35 of the vertical strip 31 and terminates at the top 36 of the vertical strip 33.

FIG. 2 illustrates an exterior 6 view of the rear 9 of the trousers 1. The waist band 26 is joined to the top 25 of the lower back portion 21 forming seam 12. The bottom 27 of the lower back portion 21 is connected to the tops 41 of the leg back portions 40 forming seam 11. Seam 11 forms one continuous seam with seam 10. Referring also to FIG. 3, the back leg portions 40 are vertically connected to the front leg portions 42 by means of a resilient, outer leg expander strip 43. The expander strip 43 is made from a resilient, stretchable material. Each back leg portion 40 is joined to an expander strip 43 along an outer leg seam 13. Each front leg portion 42 is joined to an expander strip 43 along an outer leg seam 14. The left 2 and right 3 back leg portions 40 are joined to each other in the buttocks area 62 along an anal cleft seam 15. The anal cleft seam 15 terminates at one end at seam 11. Each front leg portion 42 is also joined to a back leg portion along an inner seam 49.

As may be best seen from FIGS. 1, 2, 3 and 4, buttock pads 50 are sewn into the buttocks area 62 on the interior 7 of the upper portions 44 of the leg backs 40 on each side of the anal cleft seam 15. A resilient, stretchable material is also sewn into the knee area 63 for greater range of motion and a comfortable bend. This material, termed the back knee expander 51, is sewn into the knee portions 45 of the leg backs 40. The junction of the back knee expanders 51 and the leg backs &0 is termed the back knee seams 19.

The bottom 27 of the abdomen portion 20 is connected to the tops 46 of the leg front portions 42 forming seam 10. Seam 10 forms one continuous seam with seam 11. Thigh pads 52 are sewn into the thigh area 64 on the interior 7 of the upper portions of the leg fronts 42. Knee pads 53 are sewn into the knee area 63 on the interior 7 of the lower portions 48 of the leg fronts 42. A hem seam 16 is sewn below the knee portion 45

As may be most clearly seen from FIGS. 4, 5, 6 and 7, a pouch fly 70 is installed in the trouser crotch section 5. The pouch fly 70 has a generally triangular shape and is joined to the abdomen portion 20. The pouch fly 70 has a horizontal, top pouch cross seam 17 terminating at each end in two seams 18, 18' at acute angles to the horizontal, cross seam 17. The acute angle seams 18, 18' terminate at a junction point 71 opposite to and vertically below the cross seam 17, thereby forming a vertical, inverted triangle. The cross seam 17 is connected to and joins the abdominal seam 10, forming a natural creasing action when bending or sitting. The vertical button fly 30 terminates at a central point on the junctions of seams 10 and 17. The left and right front leg portion tops 46 join the pouch fly acute angle seams 18 and 18', respectively. The anal cleft seam 15 terminates at the acute angle seam junction 71. A triangular zipper portion 80 with three sides 81, 82, 83 is attached to the seams 17, 18 and 18'. As can be most clearly seen in FIG. 6, the zipper portion 80 is a two-way zipper that opens and closes from both sides. Although the zipper portion 80 has three sides, it is actually one continuous zipper. The zipper end 84 terminates at the seam junction 71.

As may be most clearly seen from FIGS. 1, 3, 5 and 7, a generally triangular pouch 90 with triangular zipper portion 91, corresponding to and mating with the zipper portion 80, is attached to the seam junction 71. The pouch 90 has padding 92 for protection in a loose soft material liner 93 sewn to the pouch interior 94. A triangular piece of material, defined as a corner zipper flap 72, is sewn into each corner of seams 17 and 18 and the corner of seams 17 and 18', overlapping the zipper portion junctions 81, 82 and 81, 83. A horizontal perimeter flap 73 is attached to the horizontal crotch seam 17. An acute angle perimeter flap 74 is also sewn to each acute angle crotch seam 18. The corner zipper flaps 72 and perimeter flaps 73, 74 are made from a resilient, stretchable material. In operation, the pouch zipper portion 91 interlocks with the crotch zipper portion 80. The corner flaps 72 and perimeter flaps 73, 74 overlap portions of the closed and zippered pouch 91.

It is understood that the above-described embodiment is merely illustrative of the application. A trousers trademark identifier 28 may be attached to the exterior 6 of the lower back portion 21. The trousers interior 7 may be lined with a soft material for additional comfort. The pouch line 93 may be in the form of a pocket in case a wearer wishes to use a hard cup for protection. Other embodiments may be readily devised by those skilled in the art which will embody the principles of the invention and fall within the spirit and scope thereof.

I claim:

1. A pair of trousers, having a front, back, two sides, two leg portions, an abdominal and lower back portion, a crotch, an exterior, and an interior, said trousers being adapted to be worn by a man during casual and informal athletic activities, comprising:

a one piece, soft-padded, abdominal and lower back portion divided into a front abdomen section and a rear lower back section, said abdominal and lower back portion having a top edge and a bottom edge;

a front vertical fly containing a vertical row of buttons attached to said front abdomen section and tightly securing said abdominal and lower back portion;

a soft-padded three sided pouch fly in the trouser crotch joined to the front, bottom edge of the front abdominal section beneath the vertical fly row of buttons, said pouch fly having a two-way zipper along said three sides adapting the pouch fly to be opened and closed from either side, and to be opened outward;

a hip seam attached to said bottom edge of the abdominal and lower back portion;

two outer leg seams on each leg portion attached to said bottom edge of the abdominal and lower back portion;

a resilient, stretchable material, defined as an expander strip, joining the two outer leg seams on each leg;

a resilient, stretchable material sewn into each leg back side behind a knee section;

a waistband made of a resilient, stretchable material attached to the top edge of the abdominal and lower back portion; and a soft cloth material sewn onto the interior of the abdomen, upper back, buttocks, crotch, and anus areas for softness and comfort.

2. The pair of trousers as recited in claim 1, wherein:

the abdominal and lower back portion is joined to the leg portions so that the resulting seam arches over a wearer's hip joints and continuously runs across the bottom edge of the rear lower back section.

3. The pair of trousers as recited in claim 2, wherein:

said front abdomen section and a rear lower back section form a belt like structure fastened in the front abdomen portion by said vertical button fly.

4. The pair of trousers as recited in claim 3, wherein:

said front vertical fly vertically and centrally divides the front abdomen section in left and right halves, said front abdomen section left half terminating centrally in a vertical strip with a vertical row of two or more buttons sewn thereon, said front abdomen section right half terminating centrally in a vertical strip with a vertical row of button holes corresponding to the number of buttons formed therein, said vertical strips being joined at their bottoms, said vertical strips, along with their buttons and button holes forming said front vertical fly.

5. The pair of trousers as recited in claim 4, wherein:

said waist band begins horizontally at the top of the vertical strip with buttons and terminates at the top of the vertical strip with button holes.

6. The pair of trousers as recited in claim 5, wherein:

each leg portion has a front and back, said leg back having a top attached to the bottom edge of the lower back section, said leg back also being vertically connected to said leg front by means of said outer leg expander strip;

each leg front is also joined to a leg back along an inner seam; and each leg portion is joined to each other in the buttocks area along an anal cleft seam, said anal cleft seam terminating at one end at the bottom edge of said rear lower back section and at the other end at the pouch fly.

7. The pair of trousers as recited in claim 6, wherein:

said pouch fly has a top horizontal side attached to the bottom edge of said front abdomen section and two sides extending downwardly and inwardly at acute angles to a junction point opposite to and vertically below the horizontal side, thereby forming a vertical, inverted triangle, said downwardly extending sides being attached to said leg portion fronts along tops extending downwardly from the hip area and inwardly at acute angles to said junction point, said junction point joining said anal cleft seam.

8. The pair of trousers as recited in claim 7, wherein:

said pouch fly zipper is one continuous zipper beginning at said junction point and extending along said three sides back to said junction point.

9. The pair of trousers as recited in claim 8, wherein:

said pouch fly has a generally triangular pouch, having an exterior side and an interior side, with a triangular zipper attachment portion along its perimeter, corresponding to and mating with said pouch fly zipper, attached to said junction point.

10. The pair of trousers as recited in claim 9, wherein:

said triangular pouch has protective padding in a loose soft material liner sewn to the pouch interior side.

11. The pair of trousers as recited in claim 10, wherein said pouch fly is further comprised of:

a triangular piece of material, defined as a corner zipper flap, sewn over each corner of the top horizontal side and a downwardly extending side, each said flap overlapping the corner portion of the mated pouch fly zipper and triangular zipper attachment portion;

a horizontal perimeter flap attached to the junction of the top horizontal side and front abdomen section bottom edge; and an acute angle perimeter flap attached to the junction of each downwardly extending side and leg portion front top.

12. The pair of trousers as recited in claim 11, wherein:

said zipper and perimeter flaps are made from a resilient, stretchable material.

13. The pair of trousers as recited in claim 12, further comprising:

a buttock pad sewn into the buttocks area on the interior of the upper portions of the leg backs on each side of the anal cleft seam;

a thigh pad sewn into the thigh area on the interior of the upper portions of each leg front;

a knee pad sewn into the knee area on the interior of the lower portions of each leg fronts.

14. The pair of trousers as recited in claim 13, further comprising:

a soft material lining the trousers interior.

* * * * *